US007546756B2

(12) United States Patent
Van Der Winden

(10) Patent No.: US 7,546,756 B2
(45) **Date of Patent: *Jun. 16, 2009**

(54) METHOD FOR PROCESSING A METAL SLAB OR BILLET, AND PRODUCT PRODUCED USING SAID METHOD

(75) Inventor: Menno Rutger Van Der Winden, Leiden (NL)

(73) Assignee: Corus Technology BV, Ijmuiden (NL)

( * ) Notice: Subject to any disclaimer, the term of this patent is extended or adjusted under 35 U.S.C. 154(b) by 384 days.

This patent is subject to a terminal disclaimer.

(21) Appl. No.: 10/487,146

(22) PCT Filed: Aug. 16, 2002

(86) PCT No.: PCT/NL02/00549

§ 371 (c)(1), (2), (4) Date: Aug. 4, 2004

(87) PCT Pub. No.: WO03/022469

PCT Pub. Date: Mar. 20, 2003

(65) Prior Publication Data

US 2004/0250925 A1 Dec. 16, 2004

(30) Foreign Application Priority Data

Aug. 24, 2001 (NL) ..... 1018815

(51) Int. Cl.
*B21B 39/20* (2006.01)
*B21B 35/00* (2006.01)

(52) U.S. Cl. ..... 72/250; 72/249

(58) Field of Classification Search ..... 72/205, 72/365.2, 366.2, 9.2, 10.3, 11.8, 250–252, 72/183, 249; 148/546, 610, 624, 648, 552; 164/476; 29/527.7

See application file for complete search history.

(56) References Cited

U.S. PATENT DOCUMENTS

| | | | | |
|---|---|---|---|---|
| 2,250,541 | A | 7/1941 | Lessmann | |
| 3,811,307 | A * | 5/1974 | Vydrin et al. | 72/205 |
| 3,823,593 | A * | 7/1974 | Vydrin et al. | 72/205 |
| 4,048,831 | A | 9/1977 | Fabian et al. | |
| 4,086,105 | A | 4/1978 | Mayrhofer et al. | |
| 4,145,902 | A * | 3/1979 | Imai et al. | 72/8.6 |
| 4,173,133 | A * | 11/1979 | Imai et al. | 72/8.4 |
| 4,238,248 | A | 12/1980 | Gyongyos et al. | |
| 4,299,103 | A * | 11/1981 | Marten | 72/11.8 |
| 4,339,287 | A | 7/1982 | Matsumoto et al. | |
| 4,365,496 | A * | 12/1982 | Shiozaki et al. | 72/249 |
| 4,385,511 | A * | 5/1983 | Vydrin | 72/205 |
| 4,400,963 | A | 8/1983 | Epps | |
| 4,406,715 | A | 9/1983 | Nakayama et al. | |
| 4,437,909 | A | 3/1984 | Mori et al. | |
| 4,473,416 | A * | 9/1984 | Kawamo et al. | 148/111 |
| 4,477,011 | A | 10/1984 | Austin | |
| 4,478,064 | A * | 10/1984 | Brenneman | 72/232 |
| 4,651,550 | A * | 3/1987 | Nihei et al. | 72/183 |
| 4,727,927 | A | 3/1988 | Popik | |
| 4,781,050 | A * | 11/1988 | Winter et al. | 72/205 |
| 5,393,357 | A | 2/1995 | Cho | |
| 5,665,180 | A | 9/1997 | Seetharaman et al. | |
| 5,894,879 | A | 4/1999 | Wyatt-Mair et al. | |
| 7,341,096 | B2 | 3/2008 | Van Der Winden | |
| 2005/0000678 | A1 | 1/2005 | Van Der Winden et al. | |
| 2005/0034500 | A1 * | 2/2005 | Van Der Winden et al. | 72/250 |
| 2007/0051439 | A1 * | 3/2007 | Van Der Winden | 148/546 |

FOREIGN PATENT DOCUMENTS

| | | |
|---|---|---|
| CN | 1035450 | 9/1989 |
| EP | 0310376 A2 | 4/1989 |
| JP | 54-107860 A | 8/1979 |
| JP | 55033851 | 3/1980 |
| JP | 55045507 | 3/1980 |
| JP | 55094707 | 7/1980 |
| JP | 56-030011 A | 3/1981 |
| JP | 56099004 | 8/1981 |
| JP | 57175005 | 10/1982 |

(Continued)

OTHER PUBLICATIONS

Patent Abstracts of Japan, vol. 010, No. 214 (C-362)(Jul. 25, 1986).

(Continued)

*Primary Examiner*—Dana Ross
*Assistant Examiner*—Teresa Bonk
(74) *Attorney, Agent, or Firm*—Novak Druce + Quigg LLP

(57) ABSTRACT

The invention relates to a method for processing a metal slab or billet, in which the slab or billet is passed between a set of rotating rolls of a rolling mill stand to roll the slab. According to the invention, the rolls of the rolling mill stand have a different peripheral velocity, the difference in peripheral velocity amounting to at least 10% and at most 100%, and the thickness of the slab being reduced by at most 15% for each pass or the diameter of the billet in the plane of the rolls being reduced by at most 15%. The invention also relates to a plate or billet produced using the method, and to the use of this plate or billet.

63 Claims, No Drawings

FOREIGN PATENT DOCUMENTS

| | | | | |
|---|---|---|---|---|
| JP | 60044104 | | | 3/1985 |
| JP | 60-177979 | A | | 9/1985 |
| JP | 61052317 | | | 3/1986 |
| JP | 62-137102 | A | | 6/1987 |
| JP | 10-87002 | A | | 3/1989 |
| JP | 1228602 | A | | 9/1989 |
| JP | 03032404 | | | 2/1991 |
| JP | 03032404 | A | * | 2/1991 |
| JP | 4187747 | | | 7/1992 |
| JP | 05318045 | | | 12/1993 |
| JP | 07333437 | | | 12/1995 |
| JP | 08-176676 | A | | 7/1996 |
| JP | 09108789 | A | * | 4/1997 |
| JP | 9157790 | A | | 6/1997 |
| JP | 11254093 | | | 9/1999 |
| JP | 2000-17414 | A | | 1/2000 |
| JP | 63-180306 | A | | 7/2008 |
| RU | 1789315 | | | 1/1993 |
| RU | 2006299 | | | 1/1994 |
| RU | 94023404 | | | 4/1996 |
| RU | 2100108 | | | 12/1997 |
| SU | 63448 | | | 4/1944 |
| SU | 674806 | | | 7/1979 |
| SU | 858955 | | | 8/1981 |
| SU | 880522 | | | 11/1981 |
| SU | 1061861 | | | 8/1982 |
| SU | 1629117 | | | 2/1991 |
| SU | 1731533 | | | 5/1992 |
| WO | 9700148 | | | 1/1997 |

OTHER PUBLICATIONS

Patent Abstracts of Japan, vol. 018, No. 130 (M-1570)(Mar. 3, 1994).
Patent Abstracts of Japan, vol. 1996, No. 04 (Apr. 30, 1996).
Patent Abstracts of Japan, vol. 004, No. 088 (M-017)(Jun. 24, 1980).
Patent Abstracts of Japan, vol. 004, No. 139 (M-034)(Sep. 30, 1980).
Patent Abstracts of Japan, vol. 005, No. 172 (M-095)(Oct. 31, 1981).
Patent Abstracts of Japan, vol. 004, No. 068 (M-012)(May 21, 1980).
Office Action of Apr. 5, 2006 from U.S. Appl. No. 10/487,434.
Office Action of Apr. 16, 2007 from U.S. Appl. No. 10/487,436.
Office Action of Sep. 12, 2007 from U.S. Appl. No. 10/487,436.
Office Action dated May 5, 2008 in U.S. Appl. No. 10/487,436.
Office Action of Aug. 5, 2005 for U.S. Appl. No. 10/487,434.
Office Action of Aug. 1, 2006 for U.S. Appl. No. 10/487,436.
English translation of JP 03032404, Kazama, published Feb. 13, 1991.
Office action of Nov. 25, 2008 for U.S. Appl. No. 10/487,436 to Van Der Winden.
Office action from the Canadian Patent Office dated May 27, 2008 for Canadian patent application No. 2,458,231 (corresponding to the present application).
Office action from the Canadian Patent Office dated Oct. 29, 2008 for Canadian patent application No. 2,458,231 (corresponding to the present application).
Office action from the Canadian Patent Office dated Jul. 3, 2007 for Canadian patent application No. 2,458,156 (corresponding to U.S. Appl. No. 10/487,436).

* cited by examiner

METHOD FOR PROCESSING A METAL SLAB OR BILLET, AND PRODUCT PRODUCED USING SAID METHOD

This application is a §371 National Stage Application of International Application No. PCT/NL02/00549, filed on 16 Aug. 2002, claiming the priority of Netherlands Patent Application No. 1018815 filed 24 Aug. 2001.

The invention relates to a method for processing a metal slab or billet, in which the slab or billet is passed between a set of rotating rolls of a rolling mill stand to roll the slab or extrusion.

Rolling is a very standard operation for imparting desired dimensions and properties to metals. Rolling results in an improvement to the structure as a result of grain refinement taking place under the influence of the rolling.

However, the rolling of slabs results in a considerable change in thickness, which in some cases is undesirable. For example, in aircraft construction it is necessary to have aluminum plate with a thickness of 20 to 30 cm for, inter alia, the production of floor beams for aircraft. Since cast and milled aluminum slabs currently have a maximum thickness of 60 cm, the change in thickness caused by the rolling may only amount to approximately 50%. Each pass through a rolling null stand usually results in a change in thickness of 10 to 30%.

The casting of thick aluminum slabs results in the formation of porosity in the slab, a characteristic which is inherent to the casting process. This porosity is closed up by the pressure applied as a result of the slabs being rolled a sufficient number of times. However, if it is necessary to form an aluminum plate with a thickness of 20 to 30 cm, the rolling only closes up the pores in the outermost layers of the slab, and not those in the core of the material. However, the pores in the core of the material are highly disadvantageous for the mechanical properties of the material, in particular because in a floor beam of an aircraft, for example, a large proportion of the material has to be removed by milling and the material which remains has to be able to absorb all the stresses, and pores are highly disadvantageous for the strength of the material. Also, grain refinement only occurs in the outermost layers of the plate. To close up the pores by the application of pressure and to achieve grain refinement even in the core of the plate, the degree of rolling through the thick slab therefore has to be high, which means that in most cases the slab also has to be compressed in the transverse direction, so that the plate which is formed remains thick enough.

Aluminum billets for extrusion purposes are not usually rolled. They are cast as round billets and simply cut to length for use in an extrusion press. A drawback of this is that during the extrusion of rod and wire with a large cross section in relation to the cast billet, some of the material is subject to little or no deformation, but rather is extruded in undeformed form through the extrusion die. There is then little or no grain refinement, which is unfavorable for the extruded section. Aluminum extrusion billets usually have a diameter of 40 to 600 cm.

With steel too, it is desirable to achieved grain refinement. For example, it is known that steel billets which are rolled into profiled sections, such as H-sections, often have a part which has undergone scarcely any rolling, with the result that little or no grain refinement occurs in this part. Steel billets usually have a diameter of 200 to 600 nm or cross-sectional dimensions of 200 to 600 mm if the cross section is rectangular.

It is an object of the invention to provide a method for processing a metal slab or billet by which the properties of the product produced in this way are improved.

It is another object of the invention to provide a method for processing a metal slab or billet which results in grain refinement through the entire thickness of the product obtained as a result.

Yet another object of the invention is to provide a method for processing a metal slab or billet with which the pores are closed up by pressure to a great extent.

It is also an object of tide invention to provide a metal plate or billet in which the pores have been closed up by pressure to a great extent and/or the grain refinement is homogeneous.

One of more of these objects are achieved by a method for processing a metal slab or billet, in which the slab or billet is passed between a set of rotating rolls of a rolling mill stand to roll the slab or billet, in which method the rolls of the rolling mill stand have a different peripheral velocity, and the difference in peripheral velocity is at least 10% and at most 100%, and in which method the thickness of the slab is reduced by the rolling by at most 15% per pass, or the diameter of the billet in the plane of the rolls is reduced by at most 15% by the rolling.

The fact that the rolls have, a different peripheral velocity means that shearing occurs in the slab or billet, which shearing appears to occur throughout the entire thickness of the slab or billet. It has been found that a minimum velocity difference of 10% is required to achieve this. As a result of the shearing, the pores are closed up to a great extent, and the fact that the shearing occurs across the entire thickness of the slab or billet means that even the pores in the core of the material are closed up to a great extent. Consequently, a considerable change in thickness is not required, but rather a change in thickness of at most 15% can suffice.

In addition to closing up the pores, it is important for both metal slabs and billets that the shearing gives rise to a finer grain structure over the entire thickness of the slab or billet. This imparts greater strength to the material. The shearing also breaks up the eutectic particles, which results in an improved toughness.

In addition, it is expected that the material will have an improved fatigue crack growth rate, since the grains will have a more or less knurled shape as a result of the shearing. This results in an improved toughness and a reduced susceptibility to damage.

It is also expected that the processing operation according to the invention will cause the surface layer of the material to be different than is the case with conventional rolling of the material. Ordinary rolling results in the formation of a layer comprising very fine-grained material. This layer is much thinner in the processing operation according to the invention. The expectation is that this will improve the corrosion resistance of the material. This may be favorable for all kinds of plate material, for example for use in construction.

It is also expected that the processing operation according to the invention will result in a rolled sheet with less lateral spread.

As a result of the shearing over the entire thickness of the plate, the plate, after it has been processed according to the invention, will have scarcely any or no residual stresses, so that the plate will retain its shape well after further processing, such as milling.

Obviously, a billet, if it originally had a round cross section and were rolled, resulting in an oval cross section, would have to be turned through 90° and rolled again, in order to restore the cross section of the billet to an approximately round shape. Therefore, the starting point is preferably an extrusion billet which is cast in an oval shape and is substantially round in cross section after it has been rolled.

It is preferable for the thickness of the slab or billet to be reduced by at most 8% each pass, and preferably at most 5% each pass. Since the pores are closed up according to the invention as a result of the difference in peripheral velocity between the rolls and the resulting shearing, the reduction in the thickness of the material is no longer necessary in order to close up the pores, but rather primarily to allow the rolls to grip the material. Depending on the starting material, this only requires a slight change in thickness, which is favorable, with a view to obtaining a plate of great thickness. The smaller the reduction, the thicker the thick plate remains. The same applies, mutatis mutandis, to the other benefits of the processing operation and also to billets, since all the advantages are linked to the shearing.

The difference in peripheral velocity is preferably at most 50%, more preferably at most 20%. If there is a high difference in velocity, there is a considerable risk of slipping between the rolls and the material, which would result in uneven shearing.

According to an advantageous embodiment, the rolling mill is designed in such a manner that the rolls have different diameter. This makes it possible to obtain the desired difference in peripheral velocity.

According to another advantageous embodiment, the rolls have a different rotational speed. This too makes it possible to obtain the desired difference in rotational speed.

It is also possible for these latter two measures to be combined in order to obtain the desired difference in rotational speed.

The rolling is preferably carried out at elevated temperature. This makes the rolling run more smoothly. For aluminum, the rolling is preferably carried out at a temperature between 300 and 550° C., since in this temperature range good deformation of thick aluminum slabs and (extrusion) billets is possible, more preferably between 425 and 475° C. The deformation of aluminum is easiest at approximately 450° C.

According to an advantageous embodiment of the method, the slab or billet is introduced between the rolls at an angle of between 5 and 45° with respect to the perpendicular to the plane through the center axes of the rolls. Introducing the slab or billet between the rolls at an angle makes it easier for the rolls to grip the slab or billet, with the result that the change in thickness can be kept as low as possible. Experiments have also shown that after rolling the material has an improved staightness if it is introduced at an angle between the rolls. The slab or billet is preferably fed in at an angle of between 10 and 25°, and more preferably at angle of between 15 and 25°, since with such an angle the material comes out of the rolling mill with a good level of straightness. It should be noted that the latter effect is also dependent on the reduction in the size of the material, the type of material and the alloy and the temperature.

According to an advantageous embodiment of the method, the processing operation according to the invention as described above is repeated one or more times after the rolling has been carried out for the first time. Repeating the processing operation according to the invention one or more times allows to pores to be closed up almost completely. The number of processing operations carried out according to the invention also determines thee degrees of grain refinement. The processing operation is preferably repeated twice after the first processing operation. However, the number of times that the processing operation has to be repeated depends on the thickness of the slab or the diameter of the billet, the difference in peripheral velocity of the rolls and the size of the pores in the slab or the desired grain refinement. The demands which are imposed on the size of the pores after the processing operation according to the invention obviously also play a role. It is desirable for the material to be introduced between the rolls at an angle of between 5 and 45°, preferably between 10 and 25° and more preferably between 15 and 25° during each processing operation.

If the processing operation according to the invention is repeated a number of times, according to an advantageous embodiment the slab, plate or billet can be passed through the rolling mill stand in opposite directions for each pass. The slab, plate or billet then changes direction after each rolling operation and is always passed through the same rolling mill stand. In this case, the rolls have to rotate in opposite directions for each pass. In this case too, it is desirable for the material in each case to be introduced at an angle between the rolls.

According to another advantageous embodiment, the slab, plate or billet is successively passed through two or more rolling mill stands. This method is suitable primarily for plate material, which in this way can undergo the desired processing operation very quickly.

The processing operation or operations on a metal slab with a rolling mill stand in which the rolls have different peripheral velocities is/are preferably preceded or followed by a rolling operation which is carried out using a rolling mill in which the rolls have substantially the same peripheral velocity. The latter rolling operation may, for example, comprise standard rolling, in which a significant change in thickness occurs, or shape rolling. The latter operations lead to the desired flatness, final shape and final thickness being accurately imparted to the plate formed by the rolling. After the rolling according to the invention, the plate can also be stretched in the usual way in order to provide the plate with the desired flatness without significantly changing the thickness any further.

According to one embodiment, the starting point is preferably an aluminum slab with a thickness of 20 to 60 cm. The method according to the invention can also be used to process thinner slabs, but in thinner slabs the pores are also closed up sufficiently with rolling in the standard way. The starting point is more preferably a slab with a thickness of 30 to 60 cm or of 40 to 60 cm, since the plates which are formed therefrom are of most industrial interest in view of their thickness.

According to another embodiment, the starting point is preferably an aluminum extrusion billet with a diameter of 40 to 600 cm. In practice, these are standard dimensions for the extrusion of aluminum.

According to yet another embodiment, the starting point is a steel slab with a thickness of 10 to 80 cm, preferably 20 to 40 cm. Particularly for relatively thick steel slabs, it is desirable to achieve a substantially homogenous grain refinement.

According to yet another embodiment, the starting point is a steel billet with a diameter of 20 to 60 cm. Large steel sections can be rolled from such billets.

With the method according to the invention, it is also possible to process stainless steel, copper, magnesium or titanium.

According to an advantageous embodiment, the metal slab is formed by two or more layers of metal, preferably two or more layers consisting of different alloys of a metal or different metals. In this way it is possible, for example, to produce laminated material, such as what is known as clad material for, for example, aluminum brazing sheet.

The aluminum plate which is produced using the above-described method according to the invention preferably has a thickness of between 10 and 60 cm. Thinner plate can be rolled in the usual way in order to close up pores. The plate preferably has a thickness of between 20 and 60 cm, since these thicknesses are of most industrial interest.

The extrusion billet which is processed using the above method has preferably substantially retained its diameter.

The aluminum plate preferable consists of an aluminum alloy from the AA 2xxx series or the AA 7xxx series, such as AA 2324, AA 7050 or AA 7010. The AA 7xxx alloy is in widespread use in aircraft construction. The aluminum plate according to the invention is used in an aircraft, for example as a pressure bulkhead, floor beam or wing beam.

Alternatively, the alone plate consists of an aluminum alloy from the AA 5xxx series, such as AA 5083, AA 5383 or AA 5059. This type of aluminum plate is used in ship building, for example as a water jet engine suspension ring in fast ferries, for example.

According to yet another alternative, the aluminum plate consists of an aluminum alloy from the AA 2xxx or AA 5xxx or AA 6xxx or AA 7xxx series, such as AA 2024, AA 5083, AA 6061, AA 7050 or AA 7075. This type of aluminum plate is used to make tools and dies.

The aluminum extrusion billet preferably consists of an aluminum alloy from the AA 2xxx, AA 6xxx or AA 7xxx series, such as AA 2014, AA 6061, AA 6262, AA 6082 or AA 7075. This type of aluminum billet is used to produce bar stock for the production of valve blocks, airbags and profiled sections in construction and vehicle structures, such as railroad carriages.

According to another embodiment, the starting point is a steel plate produced using the method according to the invention, preferably intercritically rolled plate, ferritically rolled plate or plate which has been rolled with thermomechanical control. The strength of this plate is at least 10% higher than the plate made from the same alloy which has been rolled conventionally.

This type of steel plate can be used for offshore applications or for the production of pipes. This plate has a strength which is at least 10% higher than the plate made from the same alloy which has been rolled conventionally.

The invention also relates to an improved metal plate or billet which has preferably been produced using the method according to the first aspect of the invention, in which the pores in the core of the plate or billet have a maximum dimension of less than 20 μm, preferably less than 10 μm. As a result of the casting operation, cast slabs and billets always have pores which are significantly larger than 20 μm. The standard rolling operations are only able to close up these pores in the core to a slight extent, or cannot do so at all. The rolling operation according to the invention makes it possible to provide plates and billets with much smaller pores.

The invention also relates to an improved metal plate or billet which is preferably produced with the aid of the method according to the first aspect of the invention, in which the unrecrystalized metal plate or billet has a deformed grain structure in the core of the plate or billet, the grains having a mean length which is 2 to 20 times greater than their thickness, preferably a length which is 5 to 20 times greater than their thickness. The fact that slabs and billets are only subject to slight deformation in the core when they are rolled in the standard way means that the metal grains in the core are scarcely deformed. The rolling operation according to the invention makes it possible to provide plates and billets with highly deformed grains. As a result, a very fine grain structure will be formed during recrystalization.

The invention also relates to an improved metal plate or billet which is preferably produced with the aid of the method according to the first aspect of the invention, in which the metal plate or billet, after recrystalization, has a substantially homogeneous degree of recrystalization over its entire thickness. The fact that the grains are all subject to shearing as a result of the rolling operation according to the invention, including the grains in the core, means that the plates and billets will be recrystalized over the entire thickness.

The metal plate or billet with this size of pores, deformed grain structure or degree of recrystalization is preferably produced from aluminum, steel, stainless steel, copper, magnesium or titanium or an alloy thereof, since these metals are readily usable for industrial purposes.

The invention will be explained with reference to an exemplary embodiment.

Experiments were carried out using slabs of aluminum AA7050 with a thickness of 32.5 mm. These slabs were rolled once in a rolling device with two rolls, of which the top roll had a diameter of 165 mm and the bottom roll had a diameter of 135 mm. After rolling, the slabs had a thickness of 30.5 mm.

The slabs were introduced at different angles varying between 5° and 45°. The temperature of the slabs when they were introduced into the rolling device was approximately 450° C. The two rolls were driven at a speed of 5 revolutions per minute.

After rolling, the slabs had a certain curvature, which was highly dependent on the angle of introduction. The straightness of the slab after rolling can to a large extent be determined by the angle of introduction, in which context the optimum angle of introduction will be dependent on the degree of reduction in the size of the slab, the type of material and alloy, and the temperature. For the slabs of aluminum which have been rolled in the experiment described above, an optimum introduction angle is approximately 20°.

A shear angle of 20° was measured in the slabs of aluminum which were rolled in accordance with the experiment described above. Using this measurement and the reduction in the size of the slab, it is possible to calculate an equivalent strain in accordance with the following formula:

$$\varepsilon_{eq} = \frac{2}{\sqrt{3}} \cdot \sqrt{(\varepsilon_{xx}^2 + \varepsilon_{yy}^2)}.$$

This formula is used to make it possible to present the strain in one dimension and is known from the book "Fundamentals of metal forming" by R. H. Wagoner and J. L. Chenot, John Wiley & Sons, 1997.

Therefore, in the slabs which have been rolled in accordance with the experiment, the equivalent strain is $$\varepsilon_{eq} = \frac{2}{\sqrt{3}} \cdot \sqrt{\left(\left(\ln\left(\frac{32.5}{30.5}\right)\right)^2 + \left(\frac{1}{2}(\tan 20°)\right)^2\right)} \approx 0.25.$$

In the case of rolling with an ordinary rolling mill, shearing does not take place across the thickness of the plate and the equivalent strain is therefore only $$\varepsilon_{eq} = \frac{2}{\sqrt{3}} \cdot \sqrt{\ln\left(\frac{32.5}{30.5}\right)^2} \approx 0.07$$

(working on the basis of a uniform strain over the entire thickness of the plate).

Therefore, the rolling using the method according to the invention results in an equivalent strain which is three to four times higher than with conventional rolling without any difference in peripheral velocity. A high equivalent strain means less porosity in the slab, greater recrystalization and therefore greater grain refinement, and more extensive breaking up of the second-phase particles (constituent particles) in the slab. These effects are generally known to the person skilled in this field of engineering if the equivalent strain increases. Therefore, the rolling according to the invention means that the resulting properties of the material are greatly improved as a result of the use of the method according to the invention.

The invention claimed is:

1. A method for processing a workpiece selected from the group consisting of a metal slab or billet, comprising:

rolling comprising passing the slab or billet between a set of rotating rolls of a rolling mill stand to roll the slab or billet, wherein the slab or billet is introduced between the rolls at an angle of between 10 and 25° with respect to a perpendicular to a plane through center axes of the rolls, wherein the slab has a thickness of at least 32.5 mm at commencement of said passing step; and wherein the rolls of the rolling mill stand comprise a faster roll and a slower roll-which respectively have a peripheral velocity, and the peripheral velocity of the faster roll is at least 10% and at most 50% greater than the peripheral velocity of the slower roll, and the thickness of the slab is reduced by the rolling by at most 15% per pass, or a thickness of the billet in the plane of the rolls is reduced by at most 15% per pass, by the rolling, wherein, after passing of the slab or billet between the set of rotating rolls of the rolling mill stand to roll the slab or billet once, the passing of the slab or billet between the set of rotating rolls of the rolling mill stand to roll the slab or billet is repeated at most one time.

2. The method as claimed in claim 1, wherein the thickness of the slab or billet is reduced by at most 8% each pass.

3. The method as claimed in claim 1, wherein the rolls of the rolling mill have respective different diameters.

4. The method as claimed in claim 1, wherein the rolls have respective different rotational speeds.

5. The method as claimed in claim 1, wherein the rolling is carried out at an elevated temperature.

6. The method as claimed in claim 1, wherein the passing step is repeated one time.

7. The method as claimed in claim 6, wherein the slab or billet is passed through the rolling mill stand in opposite directions for each pass.

8. The method as claimed in claim 1, wherein the slab or billet is successively passed through two rolling mill stands.

9. The method as claimed in claim 1, wherein the passing step is preceded or followed by a rolling operation carried out using a rolling mill in which the rolls have substantially identical peripheral velocities.

10. The method as claimed in claim 1, wherein the slab undergoes said passing step and is an aluminum slab with a thickness of 20 to 60 cm at commencement of said passing step.

11. The method as claimed in claim 1, wherein the billet undergoes said passing step and is an aluminum extrusion billet with a diameter of 40-600 cm at commencement of said passing step.

12. The method as claimed in claim 1, wherein the slab undergoes said passing step and is a steel slab with a thickness of 10 to 80 cm at commencement of said passing step.

13. The method as claimed in claim 1, wherein the billet undergoes said passing step and is a steel billet with a diameter of 20 to 60 cm at commencement of said passing step.

14. The method as claimed in claim 1, wherein the metal slab or billet comprises stainless steel, copper, magnesium or titanium.

15. The method as claimed in claim 1, wherein the metal slab is formed by two or more layers of metal.

16. The method as claimed in claim 1, wherein the slab or billet consists of aluminum alloy and is formed into aluminum plate or billet.

17. The method as claimed in claim 1, wherein the slab or billet consists of an aluminum alloy from the AA 2xxx series or the AA 7xxx series.

18. The method of claim 16, further comprising forming the plate into a part for an aircraft.

19. The method as claimed in claim 1, wherein the slab or billet consists of an aluminum alloy from the AA 5xxx series.

20. The method of claim 16, further comprising forming the plate into a part for a vessel.

21. The method as claimed in claim 1, wherein the slab or billet consists of an aluminum alloy selected from the group consisting of AA 2xxx or AA 5xxx or AA 6xxx or AA 7xxx series.

22. The method of claim 16, further comprising forming the plate into a tool or die.

23. The method as claimed in claim 1, wherein the billet consists of an aluminum alloy selected from the group consisting of AA 2xxx, AA 6xxx or AA 7xxx series.

24. The method of claim 23, further comprising producing bar stock from the billet for the production of valve blocks, airbags and profiled sections used in construction and vehicle structures.

25. The method as claimed in claim 1, wherein the slab or billet consists of steel alloy and is formed into steel plate or billet.

26. The method of claim 25, comprising using the plate for offshore applications or for the production of pipes.

27. The method of claim 1, wherein the workpiece is the slab and the slab is formed into plate and pores in the core of the plate have a maximum dimension of less than 20 μm.

28. The method of claim 1, wherein unrecrystallized metal plate or billet, in the core of the plate or billet, has a deformed grain structure, the grain having mean length which is 2 to 20 times greater than their thickness.

29. The method of claim 1, wherein the slab or billet is formed into metal plate or billet, wherein the metal plate or billet, after recrystallization, has a substantially homogeneous degree of recrystallization over its entire thickness.

30. The method as claimed in claim 1, wherein the metal is selected from the group consisting of aluminum, steel, stainless steel, copper, magnesium or titanium or an alloy thereof.

31. The method as claimed in claim 1, wherein the thickness of the slab or billet is reduced by at most 5% each pass.

32. The method as claimed in claim 1, wherein the faster roll peripheral velocity is at most 20% greater than the slower roll peripheral velocity.

33. The method as claimed in claim 1, wherein metal of the metal slab or billet is an aluminum alloy and the rolling is carried out at a temperature between 300 and 550° C.

34. The method as claimed in claim 1, wherein metal of the metal slab or billet is an aluminum alloy and the rolling is carried out at a temperature between 425 and 475° C.

35. The method as claimed in claim 1, wherein the slab or billet is introduced between the rolls at an angle of between 15 and 25° with respect to the perpendicular to the plane through the center axes of the rolls.

36. A method for processing a workpiece selected from the group consisting of a metal slab or billet, comprising:

rolling comprising passing the slab or billet between a set of rotating rolls of a rolling mill stand to roll the slab or billet, wherein the slab or billet is introduced between the rolls at an angle of between 10 and 25° with respect to a perpendicular to a plane through center axes of the rolls, wherein the slab has a thickness of at least 32.5 mm at commencement of said passing step; and wherein the rolls of the rolling mill stand comprise a faster roll and a slower roll which respectively have a peripheral velocity, and the peripheral velocity of the faster roll is at least boo and at most 50% greater than the peripheral velocity of the slower roll, and the thickness of the slab is reduced by the rolling by at most 8% per pass, or a thickness of the billet in the plane of the rolls is reduced by at most 8% per pass, by the rolling, wherein, after passing of the slab or billet between the set of rotating rolls of the rolling mill stand to roll the slab or billet once, the passing of the slab or billet between the set of rotating rolls of the rolling mill stand to roll the slab or billet is repeated at most two times.

37. The method as claimed in claim 1, wherein slab or billet undergoing said passing step is an aluminum slab with a thickness of 30 to 60 cm at the start of said passing step.

38. The method as claimed in claim 1, wherein slab or billet undergoing said passing step is an aluminum slab with a thickness of 40 to 60 cm at the start of said passing step.

39. The method as claimed in claim 1, wherein the slab undergoes said passing step and is a steel slab with a thickness of 20 to 40 cm at the start of said passing step.

40. The method as claimed in claim 1, wherein the metal slab is formed by two or more layers consisting of different alloys of a metal or different metals.

41. The method as claimed in claim 1, wherein the plate has a final thickness of between 10 and 60 cm.

42. The method as claimed in claim 1, wherein the plate has a final thickness of between 20 and 60 cm.

43. The method of claim 16, wherein the plate consists of an aluminum alloy selected from the group consisting of AA 2324, AA 7050 or AA 7010.

44. The method of claim 16, comprising forming the plate into a part for an aircraft selected from the group consisting of a pressure bulkhead, floor beam or wing beam.

45. The method of claim 16, wherein the plate consists of an aluminum alloy selected from the group consisting of AA 5083, AA 5383 or AA 5059.

46. The method of claim 16, comprising forming the plate into a water jet engine suspension ring for a vessel.

47. The method of claim 16, wherein the plate consists of an aluminum alloy selected from the group consisting of AA 2024, AA5083, AA6061, AA 7050 or AA7075.

48. The method as claimed in claim 1, wherein the billet is processed and consists of an aluminum alloy selected from the group consisting of AA2014, AA6061, AA 6262, AA 6082 or AA 7075.

49. The method of claim 23, comprising producing bar stock from the billet for the production of valve blocks, airbags and profiled sections used in railroad carriages.

50. The method as claimed in claim 1, where the slab is formed into a steel plate selected from the group consisiting of intercritically rolled plate, ferritically rolled plate or plate rolled with thermomechanical control.

51. The method of claim 27, wherein the metal slab is formed into a metal plate, wherein the pores in the core of the plate have a maximum dimension of less than 10 μm.

52. The method as claimed in claim 1, wherein the metal billet is formed into a billet, or plate, having pores in the core of the billet having a maximum dimension of less than 20 μm.

53. The method as claimed in claim 1, wherein the metal billet is formed into a billet, or plate, having pores in the core of the plate or billet having a maximum dimension of less than 10 μm.

54. The method of claim 28, wherein the metal slab or billet is formed into unrecrystallized metal plate or billet, wherein a core of the plate or billet has a deformed grain structure, the grain having mean length which is 5 to 20 times greater than their thickness.

55. The method as claimed in claim 1, wherein the metal slab is formed into unrecrystallized metal plate, wherein a core of the plate has a deformed grain structure, the grain having mean length which is 2 to 20 times greater than their thickness.

56. The method as claimed in claim 1, wherein the metal slab is formed into unrecrystallized metal plate, wherein a core of the plate has a deformed grain structure, the grain having mean length which is 5 to 20 times greater than their thickness.

57. The method as claimed in claim 1, wherein the metal slab or billet is formed into metal plate or billet which, after recrystallization, has a substantially homogeneous degree of recrystallization over its entire thickness.

58. The method of claim 28, wherein the metal is selected from the group consisting of aluminum, steel, stainless steel, copper, magnesium or titanium or an alloy thereof.

59. The method of claim 29, wherein the metal is selected from the group consisting of aluminum, steel, stainless steel, copper, magnesium or titanium or an alloy thereof.

60. The method of claim 1, wherein the workpiece is the slab at commencement of the passing step.

61. The method of claim 1, wherein the change in thickness is at most 8% per pass.

62. A method for processing a workpiece selected from the group consisting of a metal slab or billet, comprising:

rolling comprising passing the slab or billet between a set of rotating rolls of a rolling mill stand to roll the slab or billet, wherein the slab or billet is introduced between the rolls at an angle of between 10 and 25° with respect to a perpendicular to a plane through center axes of the rolls, wherein the slab has a thickness of at least 32.5 mm at commencement of said passing step; and wherein the rolls of the rolling mill stand comprise a faster roll and a slower roll which respectively have a peripheral velocity, and the peripheral velocity of the faster roll is at least 10% and at most 50% greater than the peripheral velocity of the slower roll, and the thickness of the slab is reduced by the rolling by at most 15% per pass, or a thickness of the billet in the plane of the rolls is reduced by at most 15% per pass, by the rolling, wherein the slab or billet is reduced in thickness at most 15% by the method.

63. The method as claimed in claim 36, wherein the passing step is repeated twice after the first rolling.

* * * * *